US006053176A

United States Patent [19]

Adams et al.

[11] Patent Number: 6,053,176

[45] Date of Patent: Apr. 25, 2000

[54] HEATER AND METHOD FOR EFFICIENTLY GENERATING AN AEROSOL FROM AN INDEXING SUBSTRATE

[75] Inventors: John M. Adams, Mechanicsville; Michael S. Braunshteyn, Richmond; Mohammad R. Hajaligol, Midlothian; Wesley G. Sanderson, Chester, all of Va.

[73] Assignee: Philip Morris Incorporated, New York, N.Y.

[21] Appl. No.: 09/255,316

[22] Filed: Feb. 23, 1999

[51] Int. Cl.[7] ..... A24F 13/00

[52] U.S. Cl. ..... 131/329; 131/175; 131/178; 131/190; 131/224; 131/257; 131/242; 131/260; 131/270; 128/202.21; 128/203.27

[58] Field of Search ..... 131/175, 178, 131/187, 190, 224, 257, 240.1, 242, 260, 329, 270, 271, 273; 128/202.21, 203.27

[56] References Cited

U.S. PATENT DOCUMENTS

| | | | |
|---|---|---|---|
| 4,947,873 | 8/1990 | Wang | 131/329 |
| 4,947,875 | 8/1990 | Brooks et al. | 131/273 |
| 5,388,594 | 2/1995 | Counts et al. | 131/329 |
| 5,613,505 | 3/1997 | Campbell et al. | 131/194 |
| 5,649,554 | 7/1997 | Sprinkel et al. | 131/329 |
| 5,666,977 | 9/1997 | Higgins et al. | 131/273 |

FOREIGN PATENT DOCUMENTS

| | | | |
|---|---|---|---|
| 2150272 | 6/1985 | United Kingdom | 131/329 |

*Primary Examiner*—Stanley S. Silverman
*Assistant Examiner*—Michael P. Colaianni
*Attorney, Agent, or Firm*—Connolly Bove Lodge & Hutz

[57] ABSTRACT

A system for heating a cigarette to evolve an aerosol upon consumer request comprises a cigarette and a lighter. The lighter includes a housing into which the cigarette is inserted, and a stationary heater inside the housing is positioned in thermal proximity to the cigarette. The cigarette is rotatably mounted inside the housing. When a puff is desired, heat is applied to the cigarette to produce the aerosol. Prior to the next puff, the cigarette is slightly rotated to position a fresh portion of the cigarette in proximity to the stationary heater, and this procedure is repeated until the cigarette is spent.

18 Claims, 3 Drawing Sheets

HEATER AND METHOD FOR EFFICIENTLY GENERATING AN AEROSOL FROM AN INDEXING SUBSTRATE

BACKGROUND OF THE INVENTION

The present invention relates to a heater and a method for generating an aerosol by application of heat to an indexing substrate.

Electrically powered systems for generating a flavorful aerosol from an underlying substrate are known.

For example, U.S. Pat. No. 5,060,671 incorporated herein by reference, describes an article in which a flavor-generating medium is electrically heated to evolve inhalable flavors or other components in vapor or aerosol form. A two-component device with a detachable heater/flavor generating medium portion is described. The heater/flavor generating portion, when used, may be discarded and replaced with a new heater/flavor generating portion. The power supply/control unit is reusable.

The article of U.S. Pat. No. 5,060,671 uses multiple heaters to heat discrete portions of the substrate. Sequential firing of the heaters is controlled by circuitry. Such circuitry and the multiple-heater arrangement are complex and can be costly to manufacture.

The concept of moving a circumferential heater down an extruded rod by automatic means mechanical or electromagnetic, is disclosed in U.S. Pat. No. 5,269,327 at column 7, lines 45–62.

U.S. Pat. No. 5,388,594 also describes an electrical smoking system for delivering flavors to a consumer. In that disclosure, a substantially cylindrical cigarette is inserted into a convenient hand-held lighter. The disclosure of that patent is incorporated herein by reference.

The cigarette is smoked normally and as a puff is taken, the pressure drop in the lighter causes one of a series of electrically resistive heaters to be fired. The electrically resistive heater heats the cigarette surface to a temperature which liberates certain tobacco flavors in a tobacco containing layer or the tobacco itself.

The pressure drop causes air to flow into the housing and into the cigarette. The vaporized products from the heated flavorful substrate flow through the cigarette body, through a filter, and then are ingested by the consumer.

Each heater is fired accordingly to an electronic control which selects the heater to be powered-up.

In each of these disclosures, a heat source is moved longitudinally down a cylindrical substrate either by mechanical or electronic manipulation.

Other methods of generating an aerosol from a substrate are known, e.g. from U.S. Pat. No. 5,479,948. That disclosure teaches moving a tobacco substrate in web form past an electrical heating structure in thermal proximity thereto. The web is provided in a container like an audio cassette tape, with the web replacing the magnetic recording medium on a dispense reel and a take-up reel.

Each of the above patents incorporated herein by reference, suffers from mechanical and electrical complexity, in requiring complex control circuitry, a plurality of heaters, or motors, gears, and reels. It is desirable to provide an electrical aerosol-generating article which generates an aerosol from a substrate, and which is simple, and inexpensive to manufacture.

SUMMARY OF THE INVENTION

To overcome the problems, cost, and complexity in providing an electrically powered article for generating an aerosol from an substrate in thermal proximity, the present invention contemplates supplying the end user with an indexing mechanism which rotates a cylindrical substrate of flavor-generating medium about an axis of rotation in thermal proximity with a single heater located along the circumference of the medium.

The rotation brings a portion of circumference of the flavorful aerosol generating medium into thermal proximity with the heater. For ease of reference, the flavor generating medium may be thought of as cigarette-shaped; but any geometric shape may be used which has an approximately cylindrical cross section for at least a portion of its length.

Also contemplated by the present invention is an airflow channel which assures a stream of air passes over the heater and flavor-containing substrate.

The basic apparatus for a flavorful aerosol/vapor generating device is disclosed in commonly assigned U.S. Pat. No. 5,388,594, which is expressly incorporated herein by reference in its entirety.

Such an apparatus includes a hand-held lighter unit formed with a plurality of heaters, e.g. eight, and control circuitry to fire the heaters in a predetermined pattern.

This leads to increased complexity, and consequently, increased costs. Further, the additional heaters provide additional frictional contact points between the flavor substrate and the hand-held unit. After the heaters have fired, the substrate is often considerably weakened, and may disintegrate at a frictional contact point thereby causing a jam or clog.

Applicants have developed a novel apparatus for indexing a cylindrical type substrate into thermal contact with a single heater element. This arrangement is simple and easy to manufacture, less complex, and less likely to malfunction and lead to consumer dissatisfaction.

A single heater element is provided which may have a dedicated air flow channeled to the single heater element in thermal proximity to the substrate. The air flows into the heating zone and through the heated substrate.

As the flavorful substrate is heated to a temperature sufficient to release a vapor aerosol, the channeled air is directed to this portion of the substrate directly, causing it to be thoroughly mixed. Thereafter, a wheel, lever, push-button or similar mechanism may be actuated to advance the cigarette in a rotational movement along a longitudinal axis.

BRIEF DESCRIPTION OF THE DRAWINGS

Novel features and advantages of the present invention in addition to those discussed above will become apparent to persons of ordinary skill in the art from a reading of the following detailed description in conjunction with the accompanying drawings wherein similar reference characters refer to similar parts and in which.

DETAILED DESCRIPTION OF THE INVENTION

Figure 1:
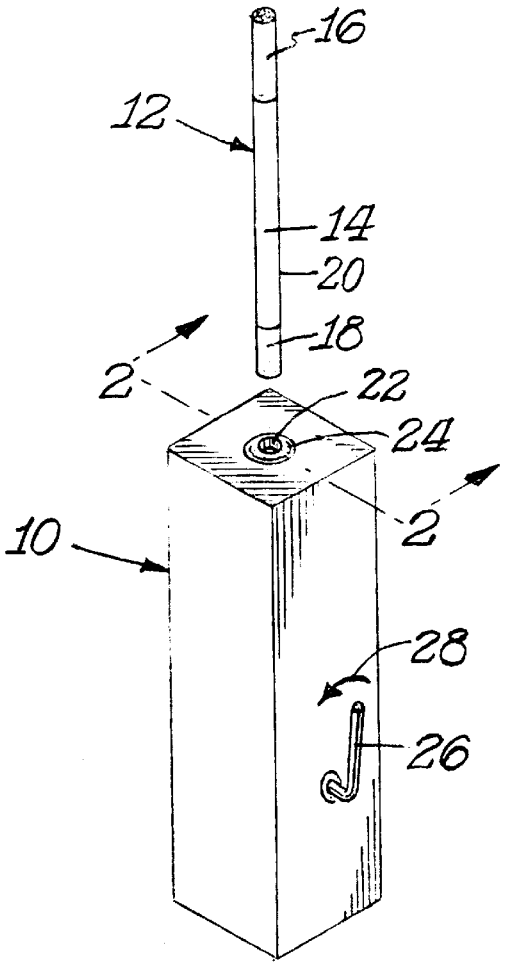
FIG. 1 is a perspective view of an apparatus including a lighter and cigarette, according to the present invention.

Referring in more particularity to the drawings, FIG. 1 illustrates an embodiment of the invention comprising a lighter 10 and a cigarette 12. The cigarette has a tobacco rod portion 14 and a filter option 16. Also, a plug or filter portion 18 may be employed to optimize airflow through surface 20 of the cigarette.

The cigarette is heated by proximate contact with a heating element, which causes heat to be transferred to a tobacco-containing substrate which rises in temperature. As more fully described in the disclosures referenced above, the increase in temperature of the tobacco or tobacco containing substrate causes the evolution an aerosol or "smoke" component.

Lighter 10 is configured with an aperture 22 which corresponds in diameter to cigarette 12. Aperture 22 may be surrounded by a sealing ring 24 which restricts air flow and provides a retaining force holding cigarette 12 in place. Ring 24 may also be rotatably mounted so that it maintains frictional contact with the cigarette, but allows rotation with respect to lighter 10. The sealing ring may be formed with air-flow passages as desired to adjust resistance-to-draw.

Figure 2:
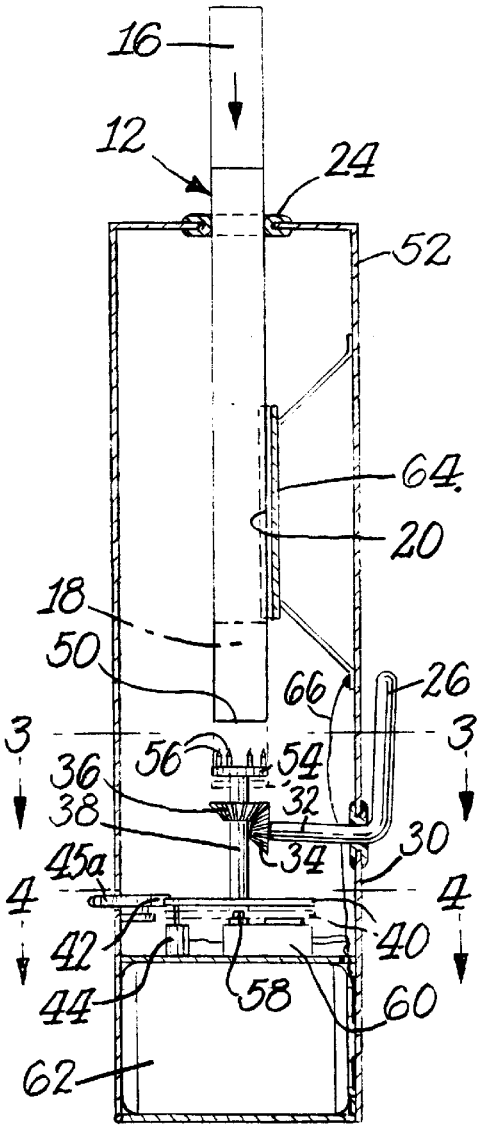
FIG. 2 is a longitudinal sectional view of the lighter taken along line 2—2 of FIG. 1 with a partially inserted cigarette therein, according to the present invention.

Lighter 10 is further provided, in one embodiment, with a lever 26 which moves in the direction indicated by arrow 28. As shown in FIG. 2, lever 26 communicates through a housing 30 of lighter 10 via a linkage rod 32.

Linkage rod 32 terminates in a vertical gear 34, which is in toothed engagement with a horizontal gear 36. This toothed engagement is preferably designed to permit a certain degree of one-directional slipping, i.e. such as that associated with a ratchet mechanism.

The horizontal gear 36 is connected to a vertical shaft 38 which provides driving force for rotation about a vertical axis.

Figure 3:
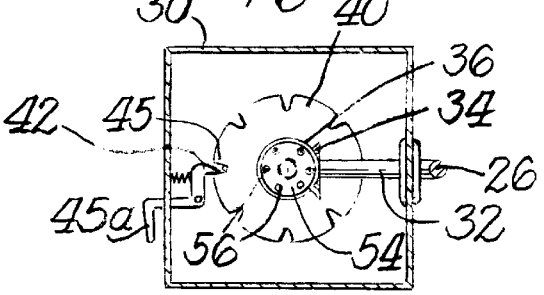
FIG. 3 is a cross-sectional view taken along line 3—3 of FIG. 2.
Figure 4:
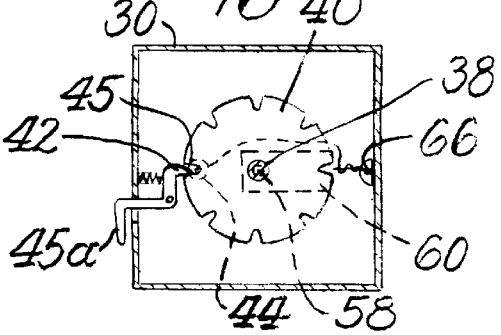
FIG. 4 is a cross-sectional view taken along line 4—4 of FIG. 2.

Vertical shaft is connected to drive an indexing wheel 40 which contacts a pawl 42 and a sensor 44. Pawl 42 provides a limited fixed rotation in radians. That is, it will for a single partial rotation allow only a certain number of radians to pass before locking the indexing wheel by entering notch 45 (as seen in FIGS. 2–4) and preventing the shaft from rotating. Pawl 42 may be released by a number of mechanisms, including a push button, lever 45*a,* or automatic release. The sensor 44 counts the number of times the wheel 40 is indexed.

Figure 8:
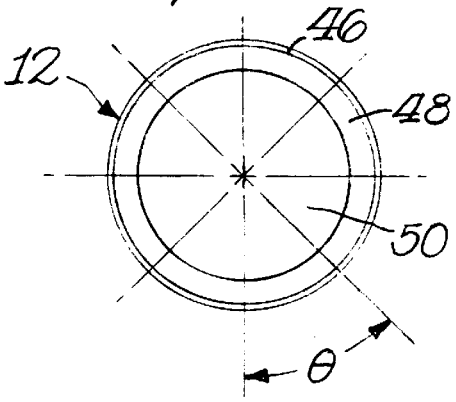
FIG. 8 is a cross-sectional view of the cigarette.

The presently preferred cigarette is illustrated in FIG. 8. Cigarette wrapping paper forms an outer layer 46. Outer layer 46 has a selected air permeability such that a transverse air flow is maintained in the cigarette through the walls, i.e. the air passes through the heated flavorful substrate and carries the volatilized flavor component in an air current toward a consumer.

In a preferred embodiment, a sublayer 48 of the cigarette is a tobacco mat or tobacco flavored mat in thermal proximity to the outer layer. Finally, an interior 50 is preferably filled with tobacco. Discerning smokers recognize that the aroma of tobacco forms an important aspect of the taste component of smoking, and filling the interior with premium tobacco adds to the flavor.

Returning to exemplary FIG. 2, it may be seen that cigarette 12 has a first ("coal") end 50 which is inserted into the housing 30 of the lighter. Sealing ring 24 is rotatably mounted in an upper end 52 of the housing. Upon complete insertion, coal end 50 seats in a receptacle 54 formed with teeth 56. Teeth 56 grip the end of the cigarette and prevent rotation relative to the indexing wheel 40.

Linkage rod 32 may be flexible, allowing a downward deflection of vertical shaft 38 when pressure is applied to receptacle 54. The terminal end of vertical shaft 38 then may contact button 58. This button may be a "reset" or "initialization" button which starts controller 60 and begins a smoking cycle involving the cigarette and lighter. A power source 62 powers the system, and a heater 64 is connected to power source 62 via a conductor 66 and the controller 60.

Initially, the system is set to "off". Insertion of a cigarette causes the initialization button 58 to be reset and turn the system "on".

When a consumer draws on the filter, a pressure drop is sensed by a sensor in or connected to controller 60. The heater element is energized through conductor 66 and rises to a high temperature. The cigarette is in thermal proximity to the heater and the surface layer is heated. Heat is transferred to the flavor generating substrate (tobacco mat, tobacco, both, or other flavors) which evolves flavored vapors which the consumer ingests.

After sufficient power has been used or a preset time has elapsed (determined by the controller) to volatilize the flavor substrate, the heater is de-energized and disabled. Subsequent puffs will be to no avail unless the cigarette is rotationally advanced.

The consumer, who may desire subsequent puffs, advances the cigarette rotationally by moving lever 26 after release of pawl 42 from engagement with the indexing wheel. This drives the gears and advances the cigarette such that a new, fresh section of the cigarette and underlying flavor containing substrate is brought into thermal proximity with the heater. The cigarette is advanced the same angular distance as the indexing wheel, which wheel is formed with indentations or notches 45 into which the pawl falls. The indentations stop angular displacement and trigger the sensor 44 informs the controller that fresh substrate is available.

The angular distance between the indentations is chosen to give a uniform distance between discrete "stops" over a complete rotation of the cigarette. This number of stops equals the number of "puffs" which may be taken from a single cigarette. After each puff is taken, a counter notes the number of puffs. After a preselected number of puffs are taken, usually equaling the number of indentations, the system is switched off and disabled.

As shown in FIG. 8, the cross sectional area of the cigarette or other flavorful substrate is conceptually divided into "quadrants" which are determined by the number of radians in each quadrant, or, the angle theta. The overall cigarette, being somewhat circular in cross-section, generally has 360 degrees in its cross-section. If the cross section is divided into eight wedges, each containing a certain amount of surface area, the angle theta is 45 degrees. The number of discrete wedges may be increased, or decreased, to a point, and the number of available fresh areas to heat on the substrate may be correspondingly increased or decreased. Preferably, the number of available fresh surfaces in a substrate should be about eight, and may be from six to ten, or even from four to twelve. Certainly, there should be at least two for efficient utilization of the substrate.

Alternative preferred and simpler versions of present invention are illustrated in the drawings and described below.

Figure 5:
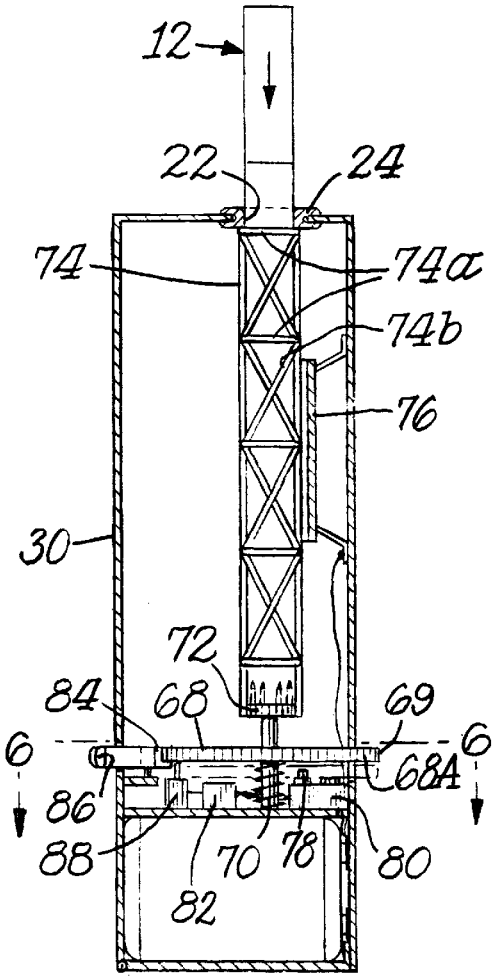
FIG. 5 is a longitudinal sectional view similar to FIG. 2 but illustrating another lighter, according to the present invention.
Figure 6:
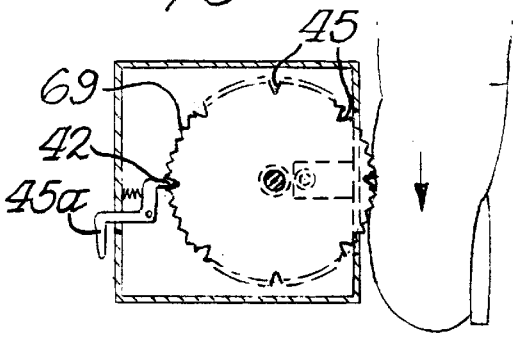
FIG. 6 is a sectional view taken along line 6—6 of FIG. 5.

FIG. 5 illustrates a version of the indexing mechanism which is "direct drive"; and has a single drive wheel 68 which may advance the cigarette in its angular rotation. Conveniently located external wheel protrusion 68*a* is that portion of the wheel which extends past the housing 30 of the lighter portion. The wheel is offset slightly from center to allow for the protrusion. As shown in FIG. 6, the drive wheel may have an external perimeter formed with grooves 69 which enable it to be rapidly turned without slippage from outside the housing of the lighter.

Returning to FIG. 5, a spring 70 keeps the wheel biased upwardly. Receptacle 72 is shown attached to guide frame 74 which receives the cigarette and maintains its position in thermal proximity to the heater 76. Guide frame 74 has transverse supports 74*a* and 74*b* which resist torsional stresses when the cigarette is rotated by actuation of the drive wheel 68 or otherwise handled by the consumer.

Upon insertion of a cigarette, the wheel 68 is pushed against spring 70, and contacts initialization button 78 mounted on controller 80. When the consumer draws on the cigarette substrate, pressure drop sensor 82 detects the drop in pressure and fires heater 76. The wheel is then rotated, and pawl mechanism 84 stops the rotation at a preselected point. The cycle is then repeated. Pawl 84 has a protrusion 86 which allows for release and rotation of the wheel. Sensor 88 counts the rotation cycles of the wheel and reports this number to the controller.

Figure 7:
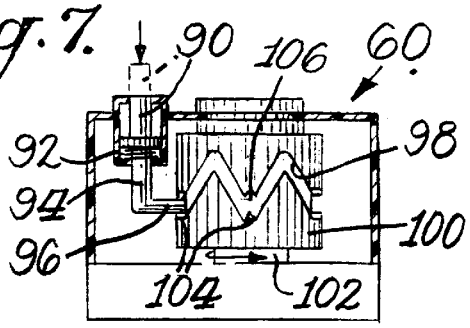
FIG. 7 is a longitudinal sectional view of another mechanism for rotating the inserted cigarette.

FIG. 7 shows a push-button advance embodiment of the present invention. The push button 90 is kept elevated by a biasing spring 92. A detent rod 94 is formed with a horizontal engaging pin 96, which fits in sliding engagement in a groove 98 formed in an indexing sleeve 100. When push button 90 is depressed, the detent rod 94 causes horizontal engaging pin 96 to slide downwardly in groove 98.

Groove 98, being formed in sleeve 100, is connected in rigid engagement to guide frame 102 which houses the cigarette. Groove 98 is formed on an angle such that when pin 98 slides therein downwardly, indexing sleeve is rotated in the direction of the arrow shown. At the end of the downward stroke, pin 98 contacts stop 104, and the user releases pressure on the push button 90. Biasing spring 92 causes the push button, detent rod, and horizontal pin to retract, whereupon pin 96 becomes lodged in recess 106 and rotational motion ceases. The apparatus then functions as described for the embodiment of FIGS. 1 and 5, for example.

The single heater also provides an unexpected benefit in that air flow management around the substrate is substantially simplified and simultaneously enhanced. Air flow, it is believed, will affect the aerosol formation and mixing vapor with ambient air may enhance aerosol formation. Applicants do not wish to be bound by this theory, but it is thought that a thorough mixing of ambient causes a subjective improvement in the overall quality of the taste component delivered and increased uniformity of delivery over the repeated course of use.

Figure 9:
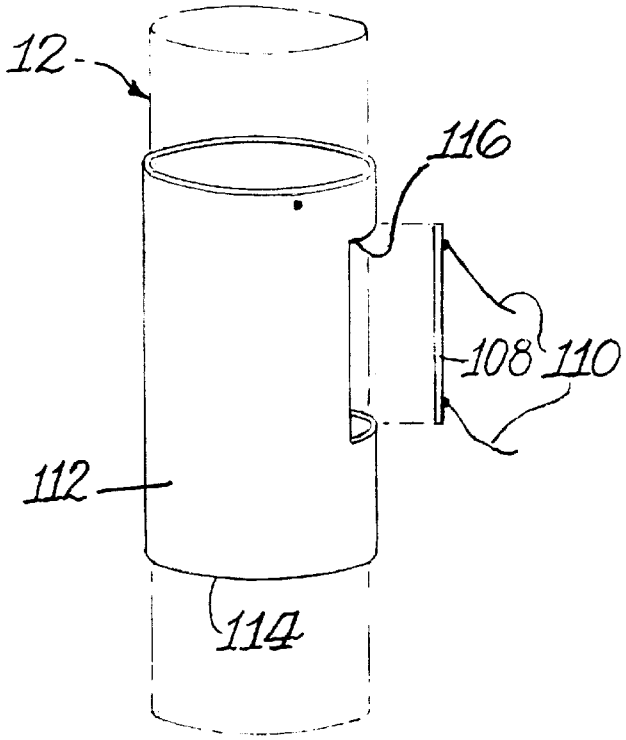
FIG. 9 is a perspective view of a flow guiding sleeve, according to the present invention.

More specifically, as the heater does not move, a dedicated air channel opening 116 is formed in a sleeve about the cigarette, as more clearly shown in FIG. 9, which is a perspective view of the internal components of this embodiment of the lighter with the housing removed.

Heater 108 is connected to power via conductors 110. The heater is in thermal proximity with a flow guiding (or "ventilation") sleeve 112, which is maintained in static relation to the heater. Heat from the heater passes through aperture 116 which is contoured to match the heating surface of the heater. The lower portion 114 of the flow guiding sleeve is closed and substantially all of the air drawn when a user inhales comes through aperture 116. Alternatively, the lower portion 114 of the sleeve may be open, allowing the drawing of ambient air through a second aperture (not shown).

The heater may be formed from any suitable heater element, including platinum, quartz, titanium aluminides, iron aluminides, semiconductors, ceramics, cermet materials, or the like. Preferably, the heaters will have thermal and oxidative stability, e.g. such as those disclosed in U.S. Pat. Nos. 5,573,692; 5,659,656; 5,595,706; 5,498,855; 5,498,850; 5,468,963; 5,408,574; 5,224,498 and 5,093,894; each of which is incorporated by reference.

Figure 10:
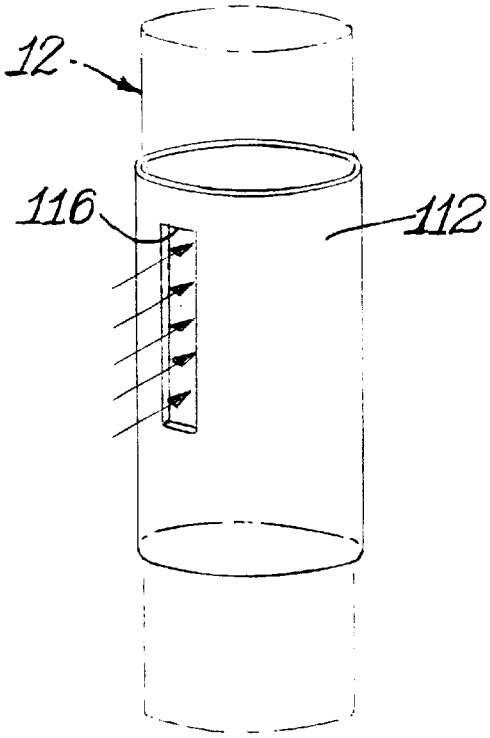
FIG. 10 is another view of the sleeve.

Such an arrangement allows for an increased velocity of transverse air flow, and possibly better mingling with the ambient air. As theoretically illustrated in FIG. 10, the velocity of air passing through the aperture 116 is large, illustrated by the arrows. This allows a greater flow to pass over the heater and heated cigarette which is giving off vapor and aerosol, for more efficient utilization of the cigarette substrate. Furthermore, where the transverse air flow intersects the longitudinal air flow, substantially more turbulence may be generated and provide additional desired mixing of the vapor product with ambient air, resulting in surprisingly enhanced flavor. This explanation is offered only by way of possible explanation; and the applicants do not wish to be bound by this theory.

Although the preferred method of heating is by resistive heating of an electrical resistive heating element, other methods such as inductive or heat radiation may be used as a way of transferring heat to the cigarette. An inductor, which in a preferred embodiment is a piece of magnetically susceptible material is placed either inside or external to the cigarette. It receives electromagnetic energy from a susceptor coil, warms up, and thereby transfers heat to the tobacco or other substrate. In other embodiments, a quartz lamp or laser light heat the tobacco substrate.

What is claimed is:

1. A system for heating a vaporizable rotating cigarette substrate to evolve an aerosol upon consumer request, comprising:

a vaporizable cigarette substrate shaped in a substantially elongate form having a longitudinal axis and having at least one substantially circular cross sectional portion with paper on the outside and an interior portion filled with tobacco, the cigarette substrate having at least two fresh areas to heat and further being adapted to be received within a lighter, and a lighter comprising a housing, a first aperture formed in the housing for insertion of the cigarette substrate and a cavity in the housing for receiving the cigarette substrate, a stationary heater located in thermal proximity to the cavity in the housing and connected to a source of electrical power, a rotator rotatably mounted in the housing for engaging and rotating the cigarette substrate, the rotator being in fixed angular relation to the received cigarette substrate, a sensor located within the housing for detecting a request for generation of aerosol and generating a signal, and a controller which records angular position and condition of use of the cigarette substrate, receives the sensor generated signal, determines whether heating the substrate will generate an aerosol, and controls power to the heater, whereby upon request an aerosol is generated from the cigarette substrate when a fresh portion of the cigarette substrate is in thermal proximity to the heater.

2. A system as in claim 1 wherein the heater is an electrically resistive heating element.

3. A system as in claim 1 wherein the heater produces inductive radiation.

4. A system as in claim 1 wherein the heater is a quartz lamp.

5. A system as in claim 1 wherein the heater is a laser light.

6. A system as in claim 1 wherein the cavity comprises a rotatably mounted cigarette receptacle which surrounds the inserted cigarette substrate and rotates about its longitudinal axis.

7. A system as in claim 1 wherein the rotator comprises an indexing wheel arranged perpendicular to the longitudinal axis of the cigarette substrate.

8. A system as in claim 7 wherein the indexing wheel has at least one notch at the periphery of the wheel.

9. A system as in claim 8 wherein the indexing wheel has a plurality of notches.

10. A system as in claim 9 wherein the indexing wheel has about eight notches.

11. A system as in claim 7 including a lever connected to drive the indexing wheel.

12. A system as in claim 7 wherein the indexing wheel partially extends outside the housing.

13. A system as in claim 12 wherein the indexing wheel has an external perimeter formed with a surface having grooves.

14. A system as in claim 1 wherein the rotator comprises an indexing sleeve mounted around the longitudinal axis of the cigarette.

15. A system as in claim 14 wherein the housing further comprises a displaceable rod having an engaging member, the indexing sleeve is formed with a continuous, angled groove around its perimeter, and the engaging member is slidingly disposed within the angled groove, whereby when the engaging member is displaced, the indexing sleeve is rotated.

16. A system as in claim 1 further comprising a ventilation sleeve surrounding the cavity for receiving the cigarette substrate disposed between the cigarette substrate and the heater, the ventilation sleeve having an aperture substantially contiguous to the heater.

17. A system as in claim 2 wherein the heater is a cermet material.

18. A system for heating a vaporizable rotating cigarette substrate to evolve an aerosol upon consumer request, comprising:

a vaporizable cigarette substrate shaped in a substantially cylindrical form having a longitudinal axis and being substantially circular in cross-section, the cigarette substrate having at least two areas to heat and including paper on the outside with an interior portion filled with tobacco and further being adapted to be received within a lighter and heated to evolve a vapor which is consumed by a consumer, a lighter comprising a housing having an aperture formed therein for insertion of a cigarette substrate and a cavity in the housing for receiving the cigarette substrate, a rotatably mounted cigarette receptacle in the housing for receiving the cigarette substrate, an electrically resistive heater located in thermal proximity to the cavity in the housing and connected to a source of electrical power, a rotator rotatably mounted in the housing for engaging and rotating the cigarette substrate and cigarette receptacle, the rotator being in a fixed angular relation to the received cigarette substrate, a sensor located within the housing for detecting a request for generation of aerosol and generating a signal, and a controller which records angular position and condition of use of the cigarette substrate, receives the sensor generated signal, determines whether heating the substrate will generate an aerosol, and controls power to the heater, whereby upon request an aerosol is generated from the substrate when fresh substrate is in thermal proximity to the heater.

* * * * *